US008878624B2

(12) United States Patent
Timofeev

(10) Patent No.: US 8,878,624 B2
(45) Date of Patent: Nov. 4, 2014

(54) MICROSTRIP TO AIRSTRIP TRANSITION WITH LOW PASSIVE INTER-MODULATION

(75) Inventor: Igor Timofeev, Dallas, TX (US)

(73) Assignee: Andrew LLC, Hickory, NC (US)

( * ) Notice: Subject to any disclaimer, the term of this patent is extended or adjusted under 35 U.S.C. 154(b) by 381 days.

(21) Appl. No.: 13/248,356

(22) Filed: Sep. 29, 2011

(65) Prior Publication Data

US 2013/0082797 A1 Apr. 4, 2013

(51) Int. Cl.
*H01P 5/02* (2006.01)

(52) U.S. Cl.
CPC ..... *H01P 5/028* (2013.01)
USPC ..... 333/24 C; 333/33

(58) Field of Classification Search
CPC ..... H01P 5/02; H01P 5/022; H01P 5/187; H01P 3/08; H01P 3/082; H01P 3/088
USPC ..... 333/24 C, 33, 116
See application file for complete search history.

(56) References Cited

U.S. PATENT DOCUMENTS 3,512,110 A * 5/1970 Clar ..... 333/116
4,365,222 A * 12/1982 Lampert ..... 333/238
4,472,690 A * 9/1984 Hallford ..... 333/35
4,578,652 A 3/1986 Sterns
5,745,017 A * 4/1998 Ralph ..... 333/116
7,298,233 B2 11/2007 Zimmerman
2003/0076198 A1 4/2003 Phillips et al.
2005/0110699 A1 5/2005 Timofeev et al.
2008/0111757 A1 5/2008 Bisiules et al.
2010/0265153 A1 10/2010 Devereux et al.

OTHER PUBLICATIONS

Notification of Transmittal of the international search report and the written opinion of the international searching authority, or the declaration for related patent PCT application No. PCT/US12/57293 dated Dec. 4, 2012.
International Preliminary Report for related patent PCT application No. PCT/US2012/057293 dated Apr. 1, 2014.

* cited by examiner

*Primary Examiner* — Benny Lee
(74) *Attorney, Agent, or Firm* — Husch Blackwell LLP

(57) ABSTRACT

A microstrip to airstrip transition is provided. The microstrip to airstrip transition includes a ground plane, a printed circuit board, a microstrip, a solder mask, and an airstrip. The ground plane has first and second sides. The printed circuit board has first and second sides and is disposed on the first side of the ground plane. The microstrip is disposed on a portion of the first side of the printed circuit board, and the solder mask is disposed over at least a portion of the microstrip. The airstrip is disposed over the at least portion of the solder mask, and the solder mask prevents direct contact between the microstrip and the airstrip.

32 Claims, 7 Drawing Sheets

MICROSTRIP TO AIRSTRIP TRANSITION WITH LOW PASSIVE INTER-MODULATION

FIELD OF INVENTION

The present invention relates generally to microwave technology and cellular base station antennas. More particularly, the present invention relates to a microstrip transition in a cellular base station antenna with low passive inter-modulation.

BACKGROUND

Cellular base station antennas are known in the art, and known base station antennas are typically one of two types: (1) a printed circuit board and cables type base station antenna or (2) an airstrip line base station antenna. Both types present disadvantages.

First, the main disadvantage for a printed circuit board and cables type of base station antenna is cost. For example, the materials for the printed circuit board and for the cables are expensive and have a high insertion loss compared to an air dielectric. Furthermore, these types of antennas include numerous cable to printed circuit board solder joints as well as printed circuit board to printed circuit board solder joints. The number of solder joints adds to the cost of the antenna and increases the risk of passive inter-modulation (PIM) failures.

Next, the main disadvantages for an airstrip line type of base station antenna are performance and size. For example, radiation from the airstrip bends and loops is prevalent. Furthermore, there is a need for significant separation between the airstrips to avoid coupling between the airstrips. However, the separation between the airstrips causes increased bulkiness of the base station antenna.

In view of the above, it would be advantageous to combine a printed circuit board microstrip and airstrip in a base station antenna. For example, phase shifters and filters can be disposed on the printed circuit board, and straight feed lines and radiators can be made with the airstrip. However, there remains a continuing, ongoing need for a printed circuit board to airstrip transition that solves the problems discussed above.

SUMMARY OF THE INVENTION

According to the present invention, a microstrip to airstrip transition according to a first embodiment is provided. The microstrip to airstrip transition can include a ground plane, a printed circuit board, a microstrip, a solder mask, and an airstrip. The ground plane can have first and second sides. The printed circuit board can also have first and second sides and can be disposed on the first side of the ground plane. The microstrip can be disposed on a portion of the first side of the printed circuit board, and the solder mask can be disposed over at least a portion of the microstrip. The airstrip can be disposed over the at least portion of the solder mask, and the solder mask can prevent direct contact between the microstrip and the airstrip.

The ground plane can include a reflector, and the ground plane can include an aluminum plate.

The solder mask can include a dielectric, and the airstrip can be capacitively coupled to the microstrip through the solder mask.

In some embodiments, the microstrip can include a first portion and a second portion. The first portion of the microstrip can be linear, and the second portion of the microstrip can be rectangular, square, or circular so that the second portion of the microstrip is wider than the first portion of the microstrip. The solder mask can be disposed over at least a portion of the second portion of the microstrip.

The microstrip to airstrip transition can also include a pin and a spring fastener disposed on opposing sides of the transition. A portion of the pin can be disposed through the airstrip, the solder mask, the microstrip, the printed circuit board, and the ground plane for connecting with the spring fastener and for securing the airstrip, the solder mask, the microstrip, the printed circuit board, and the ground plane together.

The pin can include a plastic pin, and the spring fastener can include at least one of a metal button and a beryllium bronze button. The pin can snap into the spring fastener.

The microstrip to airstrip transition can also include an airstrip support disposed on the second side of the ground plane. A portion of the airstrip support can be disposed through the ground plane and the airstrip for securing the ground plane and the airstrip together.

In some embodiments, the printed circuit board can include ground metallization.

In some embodiments, the microstrip to airstrip transition can include a crossover connected to an end of the airstrip for connecting to a second airstrip and for being disposed over an RF line at a predetermined distance therefrom.

A microstrip to airstrip transition according to a second embodiment is also provided. The microstrip to airstrip transition can include a ground plane, an airstrip, a printed circuit board, a first solder mask, a microstrip, and a second solder mask. The ground plane can have first and second sides, and the airstrip can be disposed on the first side of the ground plane. The printed circuit board can also have first and second sides and be disposed on the second side of the ground plane. The first solder mask can be disposed between the printed circuit board and the ground plane, and the microstrip can be disposed on the second side of the printed circuit board. The second solder mask can be disposed on the second side of the printed circuit board over at least a portion of the microstrip. The ground plane, the printed circuit board, and the first solder mask can prevent direct contact between the airstrip and the microstrip.

The ground plane can include a reflector, and the ground plane can include an aluminum plate.

The printed circuit board can include a dielectric, and the airstrip can be capacitively coupled to the microstrip through the printed circuit board.

In some embodiments, the microstrip to airstrip transition can also include a pin and a spring fastener disposed on opposing sides of the transition. A portion of the pin can be disposed through the airstrip, the ground plane, the first solder mask, the printed circuit board, the microstrip, and the second solder mask for connecting with the spring fastener and for securing the airstrip, the ground plane, the first solder mask, the printed circuit board, the microstrip, and the second solder mask together.

The pin can include a plastic pin, and the spring fastener can include at least one of a metal button and a beryllium bronze button. The pin can snap into the spring fastener.

According to the present invention, a microstrip to airstrip transition according to a third embodiment is also provided. The microstrip to airstrip transition can include a printed circuit board, a microstrip, a first solder mask, a second solder mask, an airstrip, and first and second ground planes. The printed circuit board can have a first side and a second side, and the microstrip can be disposed on the first side of the printed circuit board. The first solder mask can be disposed on at least a portion of the microstrip, and the second solder mask can be disposed on the second side of the printed circuit board. The airstrip can be disposed on the second solder mask, and the first and second ground planes can be disposed on opposing sides of a central conductor of the airstrip. The printed circuit board, the second solder mask, and the first ground plane can prevent direct contact between the microstrip and the airstrip.

At least one of the first and second ground planes can include a reflector, and at least one of the first and second ground planes can include an aluminum plate.

The printed circuit board can include a dielectric, and the airstrip can be capacitively coupled to the microstrip through the printed circuit board.

In some embodiments, the microstrip to airstrip transition can also include a pin and a spring fastener disposed on opposing sides of the transition. A portion of the pin can be disposed through the first solder mask, the microstrip, the printed circuit board, and the airstrip for connecting with the spring fastener and securing the first solder mask, the microstrip, the printed circuit board, and the airstrip together.

The pin can include a plastic pin, and the spring fastener can includes at least one of a metal button and a beryllium bronze button. The pin can snap into the spring fastener.

Finally, an antenna including a plurality of microstrip to airstrip transitions is provided. Each transition can include a ground plane, a printed circuit board, a microstrip, a solder mask, and an airstrip. The ground plane can have first and second sides, and the printed circuit board can have first and second sides. The printed circuit board can be disposed on the first side of the ground plane, and the microstrip can be disposed on a portion of the first side of the printed circuit board. The solder mask can be disposed over at least a portion of the microstrip, and the airstrip can be disposed over the at least a portion of the solder mask. The solder mask can prevent direct contact between the microstrip and the airstrip.

DESCRIPTION OF THE PREFERRED EMBODIMENTS

Figure 1:
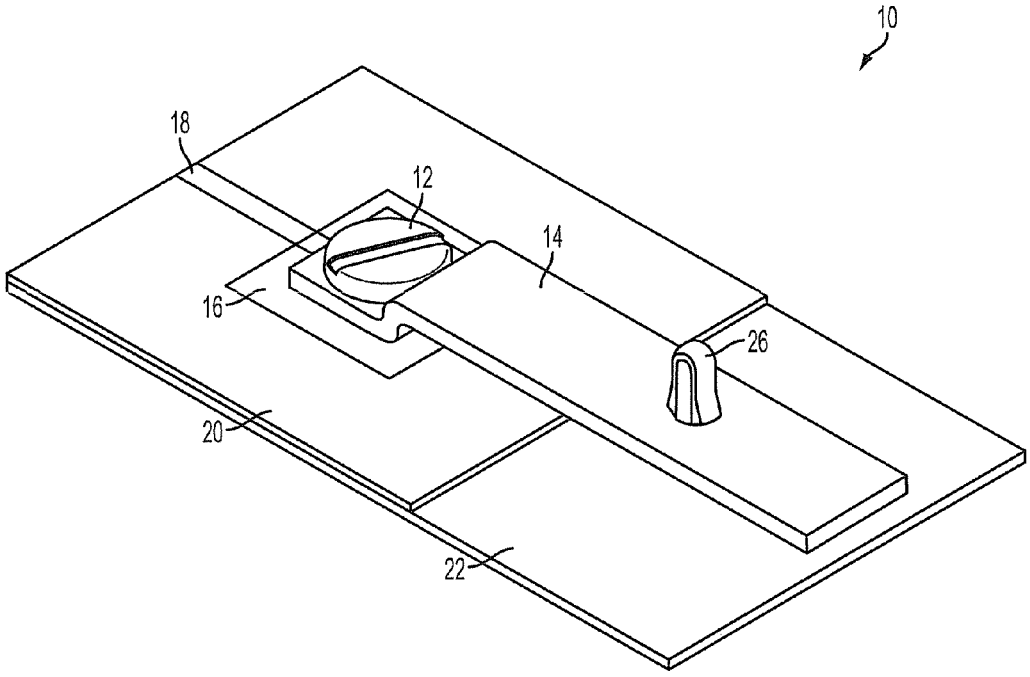
FIG. 1 is a top perspective view of a microstrip to airstrip transition in accordance with a first embodiment of the present invention.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include a microstrip to airstrip transition that solves various problems of known transitions. For example, a transition in accordance with the present invention can combine aluminum parts with compact printed circuit board parts. The aluminum parts can be low cost and include various elements, such as dipoles, power dividers, and feed lines. Various printed circuit board parts, such as phase shifters, filters, and diplexers, can be compact and thin (e.g., 15-30 mil or 0.38-0.76 mm) when disposed on the printed circuit board.

In accordance with the present invention, the microstrip to airstrip transition can avoid the use of solder joints and direct metal to metal contact. Accordingly, low passive inter-modulation (PIM) can be achieved. Furthermore, the microstrip to airstrip transition can include minimal bends and loops for airstrip lines, which can minimize parasitic radiation produced. Even further, the microstrip to airstrip transition in accordance with the present invention can include multi-layer jumpers and crossovers, providing a compact multi-layer antenna.

Transitions in accordance with the present invention can reduce cost and increase performance of known base station antennas. For example, when included in a known base station that uses cables and printed circuit boards, transitions in accordance with the present invention can reduce the cost of the base station antenna by approximately 25-30%, improve the passive inter-modulation (PIM) performance by approximately 3-4 dB, and improve gain by approximately 0.25 dB for a 1.3 m antenna and by approximately 0.5 dB for a 2 m antenna.

Transitions in accordance with the present invention can also improve reliability and reduce profiles as compared to known transitions and base stations antennas. This is because transitions in accordance with the present invention can eliminate solder joint failures and cracks in cables and because transitions in accordance with the present invention can ease the creation of multi-layer antennas. For example, a microstrip to airstrip antenna in accordance with the present invention can include snap features in lieu of solder joints, allowing for easy assembling in production.

Figure 2:
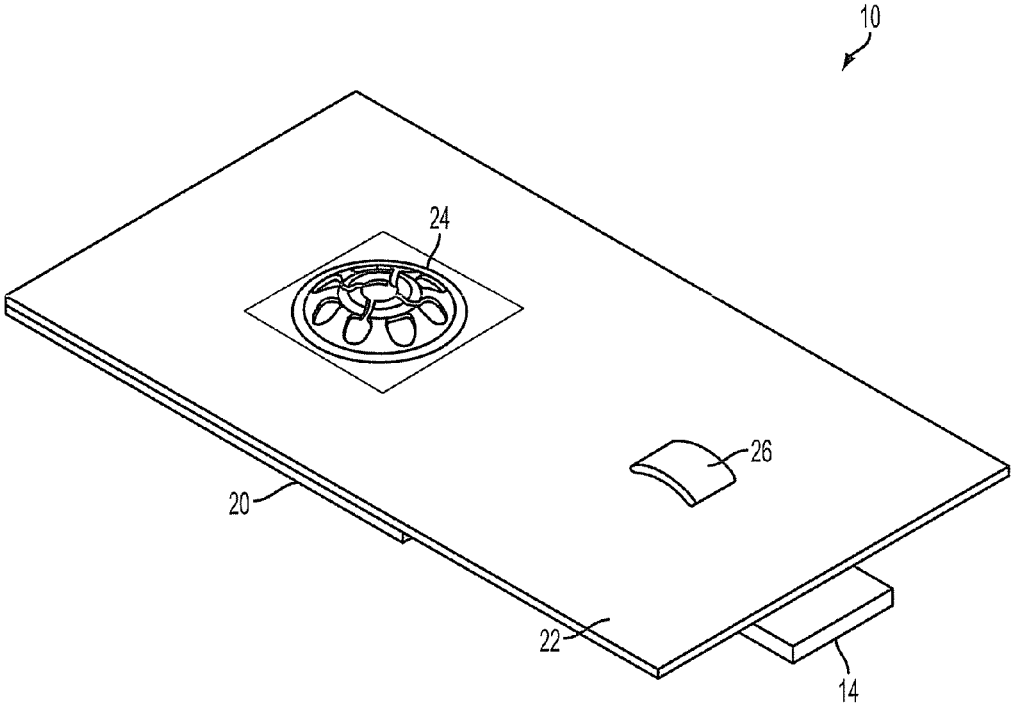
FIG. 2 is a bottom perspective view of a microstrip to airstrip transition in accordance with the first embodiment of the present invention.
Figure 3:
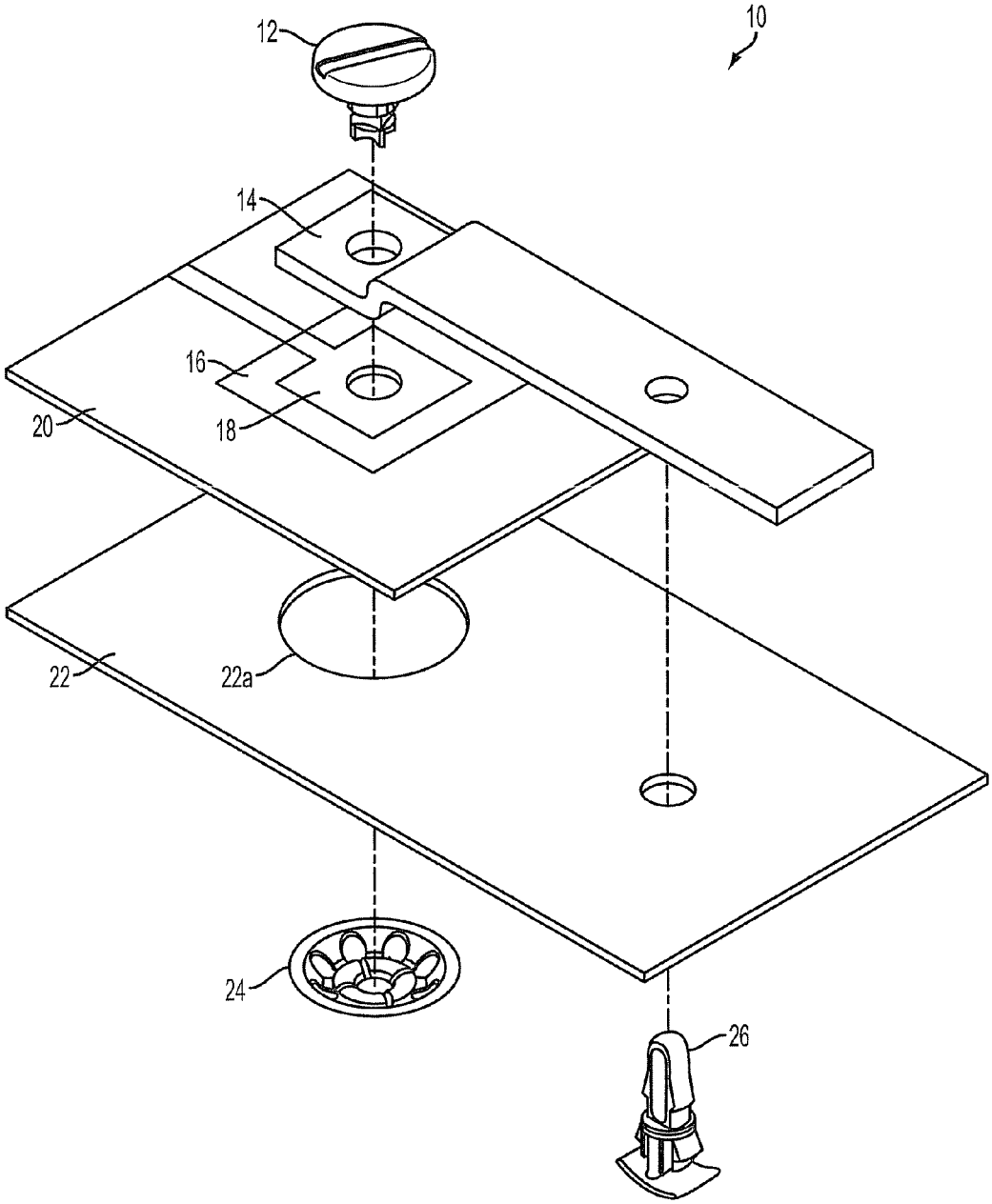
FIG. 3 is an exploded top view of a microstrip to airstrip transition in accordance with the first embodiment of the present invention.
Figure 4:
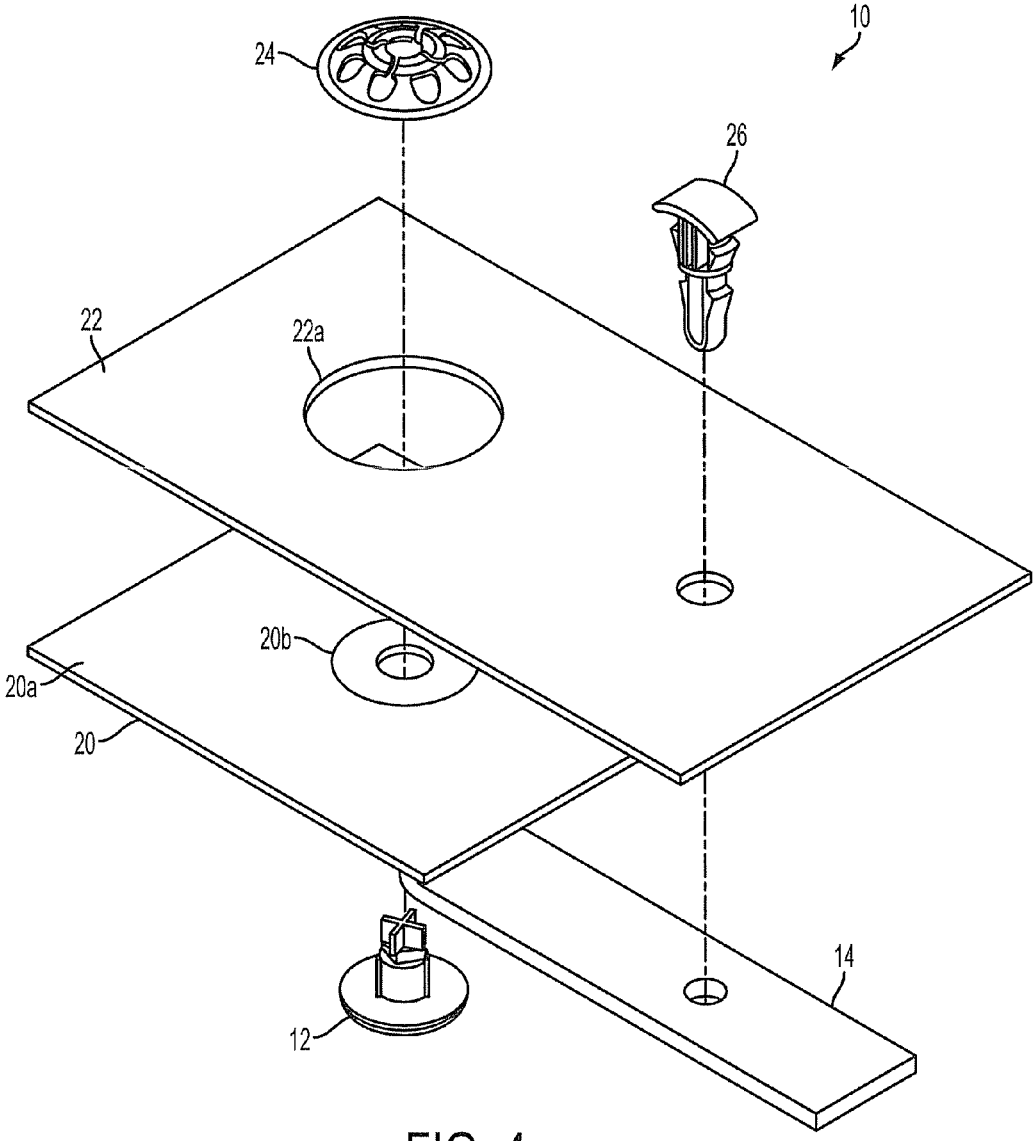
FIG. 4 is an exploded bottom view of a microstrip to airstrip transition in accordance with the first embodiment of the present invention.

FIGS. 1 and 2 are top and bottom perspective views, respectively, of a microstrip to airstrip transition 10 in accordance with a first embodiment of the present invention. FIGS. 3 and 4 are exploded top and bottom views of the microstrip to airstrip transition 10. As seen in FIGS. 1-4, the transition 10 can include a microstrip 18 and an airstrip 14. For example, the microstrip 18 (FIGS. 1,3) and the airstrip 14 can include lines and/or traces. The transition 10 in accordance with the present invention can interface the microstrip 18 to the airstrip 14.

As seen in FIGS. 1-4, the transition. 10 can include a ground plane 22, a printed circuit board 20 disposed over the ground plane 22, the microstrip 18 disposed on the printed circuit board 20, and a solder mask 16 (FIGS. 1,3) disposed on at least a portion of the microstrip 18. The ground plane 22 can include a reflector and in some embodiments, an aluminum plate.

As shown in FIGS. 1,3, a first portion of the microstrip 18 can be linear (e.g., a 50 Ohm line), and a second portion of the microstrip 18 can be rectangular, square, or circular, for example. Thus, the second portion, and accordingly, a second end, of the microstrip 18 can be wider than the first portion, and accordingly, a first end, of the microstrip 18.

In some embodiments of the present invention, the wider end of the microstrip 18 can increase the coupled area between the microstrip 18 and the airstrip 14. For example, in some embodiments, the coupled area between the microstrip 18 and the airstrip 14 can be approximately 8 $mm^2$ when deposited on a printed circuit board with a thickness of approximately 30 mil (0.76 mm). In some embodiments, the wider end of the microstrip 18 can have an area that is approximately equal to an area of the airstrip 14. To ensure impedance matching and return loss tuning, openings or apertures 20*b* (FIG. 4), 22*a* (FIGS. 3,4) can be disposed in the ground metallization 20*a* (FIG. 4) of the printed circuit board 20 and in the ground plane 22, respectively. In some embodiments, the ground metallization 20*a* can include a sheet of metal, for example, copper, disposed over at least a portion of the top and/or bottom surfaces of the printed circuit board 20.

The solder mask 16 can be sized so that the solder mask 16 overlays at least a portion of the second end of the microstrip 18. Thus, the airstrip 14 can be disposed over the solder mask 16, and the solder mask 16 can prevent direct contact between the microstrip 18 and the airstrip 14. That is, direct metal to metal contact between the microstrip 18 and the airstrip 14 can be eliminated.

In some embodiments, the solder mask 16 can be a low loss dielectric with a thickness of approximately 0.5 mil to approximately 1.5 mil (0.01 mm to 0.04 mm). Accordingly, capacitive coupling between the microstrip 18 and the airstrip 14 can be achieved through the solder mask 16. This type of capacitive coupling can improve passive inter-modulation (PIM) performance.

As seen in FIGS. 1-4, a fastener 12 (FIGS. 1, 3, 4), for example, a plastic pin, can be disposed near a first end of the transition 10. The fastener 12 can be disposed on a top side of the transition 10, and a portion of the fastener 12 can be disposed in first holes, openings, or windows of the airstrip 14, the solder mask 16, the microstrip 18, the ground plane 20, and the printed circuit board 22.

According to some embodiments of the present invention, a diameter of the fastener 12 can have a smaller diameter than a diameter of the hole, opening, or window in the ground plane 22. Thus, contact between the fastener 12 and the opening of the ground plane 22 can be prevented.

A spring fastener 24 (FIGS. 2, 3, 4), for example, a metal button such as a beryllium bronze button, can be disposed on a bottom side of the transition 10 for receiving a portion of the fastener 12. That is, the fastener 12 can snap with and into the spring fastener 24. Thus, the combination of the fastener 12 and the spring fastener 24 can create a spring connection to secure the airstrip 14, solder mask 16, microstrip 18, printed circuit board 20, and ground plane 22 together near a first end thereof.

An airstrip support 26, for example a plastic airstrip support, can be inserted into holes, openings, or windows near a second end of the transition 10. For example, as seen in FIGS. 1-4, the airstrip support 26 can be disposed on a bottom side of the transition 10, and a portion of the airstrip support 26 can be disposed in second holes of the ground plane 22 and airstrip 14. The airstrip support 26 can be dimensioned so that, once disposed through the holes of the ground plane 22 and airstrip 14, a fastener on a top side of the transition 10 is not needed to secure the airstrip support 26 in place.

In some embodiments of the present invention and as seen in FIG. 2, the airstrip support 26 does not pass through the solder mask 16, the microstrip 18, or the printed circuit board 20. This is because, in some embodiments, the solder mask 16, the microstrip 18, and the printed circuit board 20 are disposed on only a portion of the ground plane 22.

The printed circuit board 20 in accordance with the present invention may or may not have ground metallization 20*a*. In embodiments in which the printed circuit board 20 includes ground metallization 20*a*, the solder mask 16 can be disposed between two ground planes for capacitive coupling therebetween and for preventing direct metal to metal contact between the ground metallization 20*a* and the ground plane 22.

In embodiments in which the printed circuit board 20 includes ground metallization 20*a*, the holes, openings, or windows 20*b*, 22*a* in the ground metallization 20*a* of the printed circuit board 20 and in the ground plane 22, respectively, can be used for compensation of parallel capacitance with the wider end of the microstrip 18. Accordingly, improved return loss can be achieved in a wide frequency band. For example, in some embodiments, a return loss can be greater than approximately 23 dB when the frequency is between approximately 0.7 GHz and 2.7 GHz.

The thickness of the printed circuit board 20 can be approximately 15-30 mil (0.38-0.76 mm). This small thickness of the printed circuit board 20 can further reduce cost of the transition 10 in accordance with the present invention.

Figure 5:
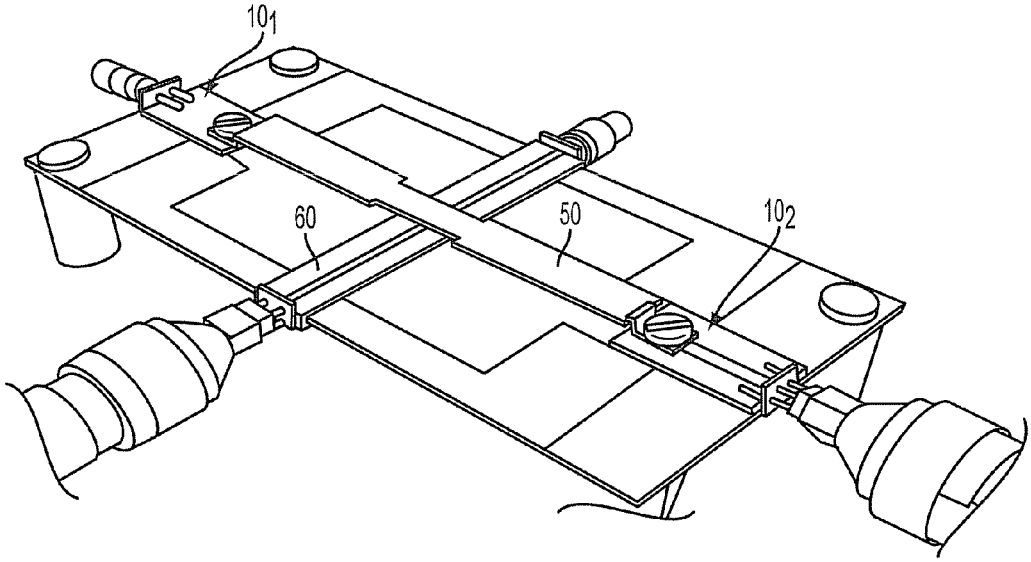
FIG. 5 is a perspective view of a crossover and two transmission lines based on two microstrip to airstrip transitions in accordance with the present invention.

In some embodiments, transitions $\mathbf{10}_1$, $\mathbf{10}_2$ in accordance with the present invention can be incorporated into a jumper or crossover 50. For example, as seen in FIG. 5, a crossover 50 of two transmission lines can be used to intersect two microstrip to airstrip transitions $\mathbf{10}_1$, $\mathbf{10}_2$ in accordance with the present invention. Thus, the crossover 50 can intersect the microstrips and airstrips of the transitions $\mathbf{10}_1$, $\mathbf{10}_2$.

Use of the crossover 50 can maintain a good return loss that is greater than approximately 23 dB for all ports. Furthermore, use of the crossover 50 can achieve low coupling between a first line 60 and a second line 50, where the second line 50 includes the crossover and the two intersected transitions. When a height of the airstrip and/or the crossover 50 over the first line 60 is increased, the coupling between the first line 60 and the second line 50 can be even further reduced. Thus, transitions $\mathbf{10}_1$, $\mathbf{10}_2$ and crossovers 50 can be used in a compact antenna that incorporates two-layer RF circuitry.

Figure 6A:
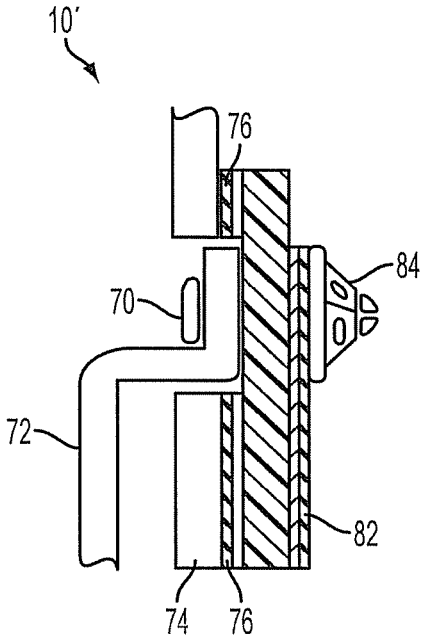
FIG. 6A is a side view of a microstrip to airstrip transition in accordance with a second embodiment of the present invention.
Figure 6B:
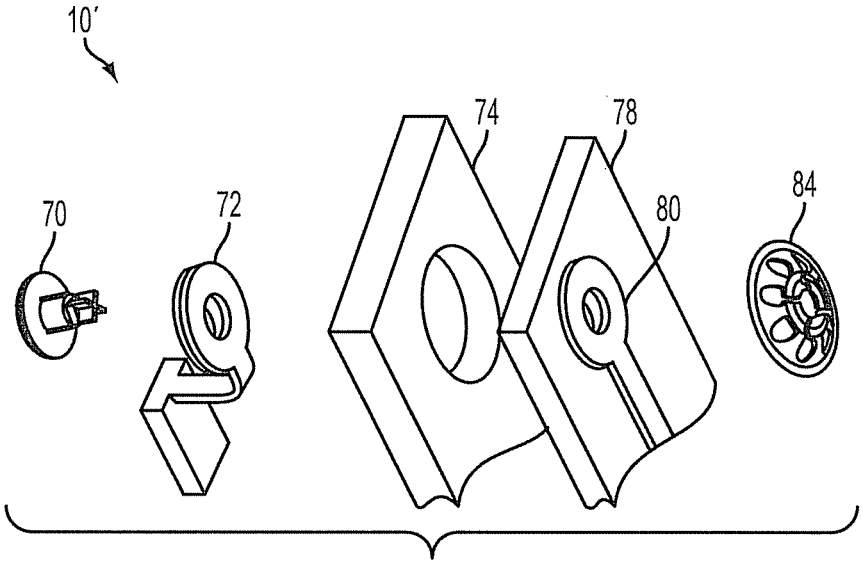
FIG. 6B is a side exploded view of a microstrip to airstrip transition in accordance with the second embodiment of the present invention.

A transition 10 in accordance with the present invention has been shown and described. However, a transition 10' in accordance with an alternate embodiment of the present invention is also provided. As seen in FIGS. 6A and 6B, in the transition 10', a microstrip 80 (FIG. 6B) and an airstrip 72 can be disposed on opposing sides of a ground plane 74. The ground plane 74 can include a reflector and in some embodiments, an aluminum plate.

A fastener 70 and the airstrip 72 can be disposed on a first side of the ground plane 74. Solder masks 76, 82 as shown in FIG. 6A, a printed circuit board 78 as shown in FIG. 6B, a microstrip 80, and a spring fastener 84 can be disposed on a second side of the ground plane 74. For example, first and second solder masks 76, 82 can be disposed on the second side of the ground plane 74 with the printed circuit board 78 disposed therebetween. The microstrip 80 can be disposed on the side of the printed circuit board 78 facing the second solder mask 82, and the spring fastener 84 can be disposed on the side of the second solder mask 82 that is opposite the microstrip 80. At least a portion of the fastener 70 can be disposed through the airstrip 72, the ground plane 74, the printed circuit board 78, the microstrip 80, and the solder masks 76, 82 to connect to the spring fastener 84 on an opposite side thereof and securing the elements of the transition 10' together.

The transition 10' can be employed in long and multi-band antennas to make these antennas more compact. In these embodiments, an RF connection between the airstrip 72 and the microstrip 80 can be achieved by capacitive coupling through the printed circuit board because in some embodiments, the printed circuit board 78 can be a dielectric. In some embodiments, reactance of the transition 10' can be compensated by narrowing the airstrip 72.

Figure 7:
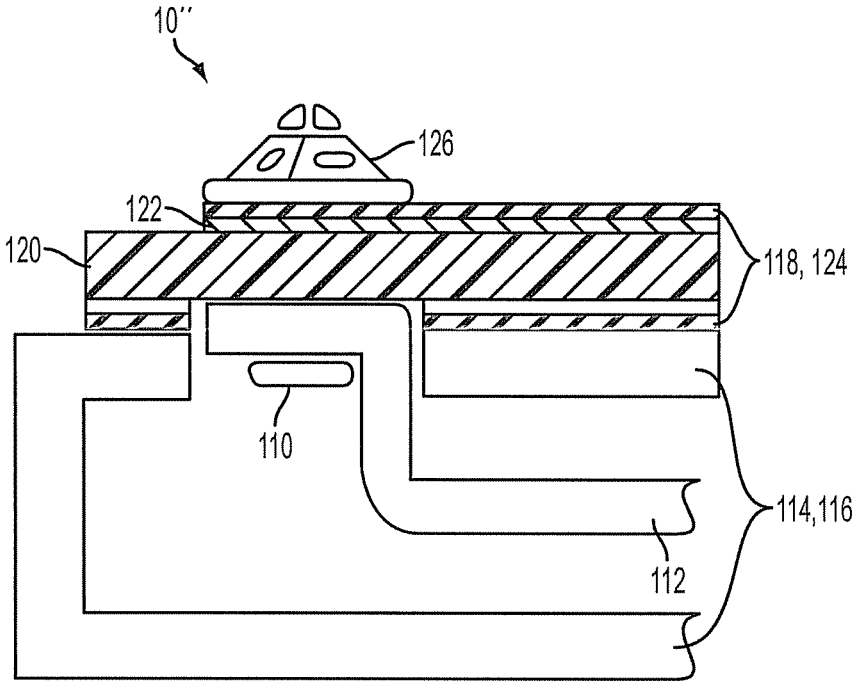
FIG. 7 is a side view of a microstrip to tri-plate airstrip line transition in accordance with the present invention.

In another alternate embodiment, an airstrip transmission line can be employed that is a symmetrical or tri-plate airstrip line with two parallel ground planes. These types of airstrip lines can also be used in base station antennas. For example, as seen in FIG. 7, a transition 10" can include a central conductor of an airstrip 112 disposed between top and bottom ground planes 114, 116 on a first side of a printed circuit board 120. A first solder mask 118 can separate the first ground plane 116 from the printed circuit board 120. The microstrip 122 and a second solder mask 124 can be disposed on a second side of the printed circuit board 120. In some embodiments, at least a portion of a fastener 126 can be disposed through the solder mask 124, the microstrip 122, the printed circuit board 120, and a portion of the airstrip 112 for connecting to a spring fastener 110 on an opposite side thereof and securing such elements of the transition 10" together.

In the transition 10", capacitive coupling can be achieved between the microstrip 122 and the center, conductor of the airstrip 112 through the printed circuit board 120, which can be a dielectric.

In some embodiments, a plurality of transitions 10, 10', or 10" and others accordance with the present invention can be incorporated into an antenna array to achieve a low cost antenna array. For example, an antenna in accordance with the present invention can eliminate cables, include ten times less solder joints than known antennas, eliminate direct metal to metal contacts, and include fewer parts as compared to known antennas. Limited printed circuit board parts can include phase shifters and dividers connected by transitions 10, 10', or 10" to airstrip parts that can include feed lines with radiators and minimal bends, and thus, with minimal parasitic radiation. These and other objects of an antenna in accordance with the present invention can be achieved with the use of only snap and/or capacitive joints, which are desired during mass production of antennas.

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the sprit and scope of the claims.

What is claimed is:

1. A microstrip to airstrip transition comprising:

a ground plane, the ground plane having first and second sides;

a printed circuit board, the printed circuit board having first and second sides, the printed circuit board disposed on the first side of the ground plane;

a microstrip disposed on a portion of the first side of the printed circuit board;

a solder mask disposed over at least a portion of the microstrip;

an airstrip disposed over the at least portion of the solder mask; and a pin and a spring fastener disposed on opposing sides of the transition, wherein the solder mask prevents direct contact between the microstrip and the airstrip, and wherein a portion of the pin is disposed through the airstrip, the solder mask, the microstrip, the printed circuit board, and the ground plane for connecting with the spring fastener and for securing the airstrip, the solder mask, the microstrip, the printed circuit board, and the ground plane together.

2. The microstrip to airstrip transition according to claim 1, wherein at least a portion of the ground plane is a reflector.

3. The microstrip to airstrip transition according to claim 2, wherein the at least a portion of the ground plane is an aluminum plate.

4. The microstrip to airstrip transition according to claim 1, wherein the solder mask includes a dielectric.

5. The microstrip to airstrip transition according to claim 4, wherein the airstrip is capacitively coupled to the microstrip through the solder mask.

6. The microstrip to airstrip transition according to claim 1, wherein the microstrip includes a first portion and a second portion, the first portion of the microstrip being linear, and the second portion of the microstrip being rectangular, square, or circular so that the second portion of the microstrip is wider than the first portion of the microstrip.

7. The microstrip to airstrip transition according to claim 6, wherein the solder mask is disposed over at least a portion of the second portion of the microstrip.

8. The microstrip to airstrip transition according to claim 1, further comprising a crossover connected to an end of the airstrip for connecting to a second airstrip and for being disposed over an RF line at a predetermined distance therefrom.

9. The microstrip to airstrip transition according to claim 1, wherein the pin includes a plastic pin.

10. The microstrip to airstrip transition according to claim 1, wherein the spring fastener includes at least one of a metal button and a beryllium bronze button.

11. The microstrip to airstrip transition according to claim 1, wherein the pin snaps into the spring fastener.

12. The microstrip to airstrip transition according to claim 1, further comprising an airstrip support disposed on the second side of the ground plane, wherein a portion of the airstrip support is disposed through the ground plane and the airstrip for securing the ground plane and the airstrip together.

13. The microstrip to airstrip transition according to claim 1, wherein the printed circuit board further includes ground metallization.

14. An antenna comprising a plurality of microstrip to airstrip transitions, each transition comprising:

a ground plane, the ground plane having first and second sides;

a printed circuit board, the printed circuit board having first and second sides, the printed circuit board disposed on the first side of the ground plane;

a microstrip disposed on a portion of the first side of the printed circuit board;

a solder mask disposed over at least a portion of the microstrip;

an airstrip disposed over the at least a portion of the solder mask; and a pin and a spring fastener disposed on opposing sides of each transition, wherein for each transition the respective solder mask prevents direct contact between the corresponding microstrip and the corresponding airstrip, and wherein a portion of the respective pin disposed through the corresponding airstrip, the corresponding solder mask, the corresponding microstrip, the corresponding printed circuit board, and the corresponding ground plane for connecting with the respective spring fastener and for securing the corresponding airstrip, the corresponding solder mask, the corresponding microstrip, the printed circuit board, and the ground plane together.

15. A microstrip to airstrip transition comprising:

a ground plane, the ground plane having first and second sides;

an airstrip disposed on the first side of the ground plane;

a printed circuit board, the printed circuit board having first and second sides and disposed on the second side of the ground plane;

a first solder mask disposed between the printed circuit board and the ground plane;

a microstrip disposed on the second side of the printed circuit board; and a second solder mask disposed on the second side of the printed circuit board over at least a portion of the microstrip, wherein the ground plane, the printed circuit board, and the first solder mask prevent direct contact between the airstrip and the microstrip.

16. The microstrip to airstrip transition according to claim 15, wherein at least a portion of the ground plane is a reflector.

17. The microstrip to airstrip transition according to claim 16, wherein the at least a portion of the ground plane is an aluminum plate.

18. The microstrip to airstrip transition according to claim 15, wherein the printed circuit board includes a dielectric.

19. The microstrip to airstrip transition according to claim 18, wherein the airstrip is capacitively coupled to the microstrip through the printed circuit board.

20. The microstrip to airstrip transition according to claim 15, further comprising a pin and a spring fastener disposed on opposing sides of the transition, wherein a portion of the pin is disposed through the airstrip, the ground plane, the first solder mask, the printed circuit board, the microstrip, and the second solder mask for connecting with the spring fastener and for securing the airstrip, the ground plane, the first solder mask, the printed circuit board, the microstrip, and the second solder mask together.

21. The microstrip to airstrip transition according to claim 20, wherein the pin includes a plastic pin.

22. The microstrip to airstrip transition according to claim 20, wherein the spring fastener includes at least one of a metal button and a beryllium bronze button.

23. The microstrip to airstrip transition according to claim 20, wherein the pin snaps into the spring fastener.

24. A microstrip to airstrip transition comprising:

a printed circuit board, the printed circuit board having a first side and a second side;

a microstrip disposed on the first side of the printed circuit board;

a first solder mask disposed on at least a portion of the microstrip;

a second solder mask disposed on the second side of the printed circuit board;

an airstrip disposed on the second side of the printed circuit board; and first and second ground planes disposed on opposing sides of a central conductor of the airstrip, wherein the printed circuit board, the second solder mask, and the first ground plane prevent direct contact between the microstrip and the airstrip.

25. The microstrip to airstrip transition according to claim 24, wherein at least a portion of one of the first and second ground planes is a reflector.

26. The microstrip to airstrip transition according to claim 25, wherein the at least a portion of the one of the first and second ground planes is an aluminum plate.

27. The microstrip to airstrip transition according to claim 24, wherein the printed circuit board includes a dielectric.

28. The microstrip to airstrip transition according to claim 27, wherein the airstrip is capacitively coupled to the microstrip through the printed circuit board.

29. The microstrip to airstrip transition according to claim 24, further comprising a pin and a spring fastener disposed on opposing sides of the transition, wherein a portion of the pin is disposed through the first solder mask, the microstrip, the printed circuit board, and the airstrip for connecting with the spring fastener and securing the first solder mask, the microstrip, the printed circuit board, and the airstrip together.

30. The microstrip to airstrip transition according to claim 29, wherein the pin includes a plastic pin.

31. The microstrip to airstrip transition according to claim 29, wherein the spring fastener includes at least one of a metal button and a beryllium bronze button.

32. The microstrip to airstrip transition according to claim 29, wherein the pin snaps into the spring fastener.

* * * * *